US006003976A

United States Patent [19]

Tani et al.

[11] Patent Number: 6,003,976

[45] Date of Patent: Dec. 21, 1999

[54] APPARATUS FOR ELECTROSTATICALLY FORMING IMAGES USING TIME STABLE REFERENCE VOLTAGE

[75] Inventors: Kenji Tani, Yamatokoriyama; Kazuya Masuda, Nara; Suehiro Ueda, Shiki-gun; Yuusuke Nagano, Yamatokoriyama, all of Japan

[73] Assignee: Sharp Kabushiki Kaisha, Osaka, Japan

[21] Appl. No.: 09/018,011

[22] Filed: Feb. 3, 1998

[30] Foreign Application Priority Data

Feb. 21, 1997 [JP] Japan ..... 9-038171

[51] Int. Cl.[6] ..... B41J 2/06

[52] U.S. Cl. ..... 347/55

[58] Field of Search ..... 347/55, 154, 103, 347/123, 111, 159, 127, 128, 17, 141, 120, 151; 399/291, 293, 295, 271

[56] References Cited

U.S. PATENT DOCUMENTS

| | | | |
|---|---|---|---|
| 5,650,809 | 7/1997 | Kitamura | 347/55 |
| 5,708,464 | 1/1998 | Desie | 347/55 |
| 5,790,139 | 8/1998 | Umeno et al. | 347/70 |

FOREIGN PATENT DOCUMENTS

| | | |
|---|---|---|
| 0448026 | 9/1991 | European Pat. Off. . |
| 0720072 | 7/1996 | European Pat. Off. . |
| 0788887 | 8/1997 | European Pat. Off. . |
| 06328769 | 11/1994 | Japan . |
| 10235923 | 8/1998 | Japan . |

*Primary Examiner*—John Barlow
*Assistant Examiner*—Raquel Yvette Gordon
*Attorney, Agent, or Firm*—David G. Conlin; David A. Tucker

[57] ABSTRACT

A reference voltage generating circuit generates +5 V and +24 V as the reference voltages, based on the voltage from the commercial power supply, i.e., AC 100 V. This reference voltage generating circuit supplies +5 V and +24 V to various operating circuits. The reference voltage of the +5 V system is supplied to a logic circuit portion and a voltage applying device. The reference voltage of the +24 V system is supplied to a control electrode voltage source for generating the voltage to be applied to the control electrode, a fixing lamp operating portion for generating the voltage to activate heater as a part of the fixing unit, and a motor operating portion for driving motors for driving various driving devices.

11 Claims, 8 Drawing Sheets

APPARATUS FOR ELECTROSTATICALLY FORMING IMAGES USING TIME STABLE REFERENCE VOLTAGE

BACKGROUND OF THE INVENTION (1) Field of the Invention

The present invention relates to an image forming apparatus which forms the image on a recording medium by causing the developer to jump thereto and can be applied to a printer unit in digital copiers and facsimile machines as well as to digital printers, plotters, etc.

(2) Description of the Prior Art

Known methods for forming a visual image on a recording material such as paper etc., in accordance with an electric signal output from computers, word processors, facsimile machines etc., include an ink jet mechanism using ink, thermal transfer process of fusing ink and transferring it, a sublimation process, an electrophotographic process etc.

With recent development to high speed, high quality, and low cost, the ink jet mechanism which has a relatively simple device configuration having non-impact type print heads integrated therein has been often employed. In this ink jet mechanism, however, a good image cannot be obtained due to blooming of liquid ink used, and further, when color printing is performed by superimpositional printing, color mixing from the mixing of inks cannot be obtained. For these reasons, when high quality is needed, printing by the electrophotographic process using toner has been employed.

Prints using toner are free from blooming, and can provide visually excellent images having high color density. Further, when a plurality of colors are mixed for development into color images, these colors can be mixed during the fixing process to provide the correct color mixture. For these reasons, there has been proposed a direct printing mechanism using toners, which performs printing by combination of the simple ink jet process and the toner image.

For example, Japanese Patent Application Laid-Open Hei 6 No. 328,769, has disclosed a means of forming a toner image on paper, which includes a toner flow controlling means having apertures for controlling the flow of toner, a toner supplying means for supplying toner to the toner flow controlling means and a rearside electrode which is disposed on the side opposite the toner supplying means with respect to the toner flow controlling means, and is configured in such a manner that voltages are applied to the toner-flow controlling means in accordance with the image information so as to control the passage of toner through the apertures of the toner flow controlling means, to thereby form a toner image on the paper which is being conveyed over the rearside electrode.

Here, in the above disclosure, i.e., Japanese Patent Application Laid-Open Hei 6 No. 328,769, the toner flow controlling means has a control voltage applying circuit connected thereto, which is composed of an image signal outputting circuit and piezoelectric transformers. This piezoelectric transformer boosts the image signal of relatively low in voltage, into a high voltage, to control the flow of toner.

For example, information-related apparatuses such as printers etc., tend to markedly reduce in size and cost, and hence components constituting such an apparatus are designed as to be reduced in size and cost. Of these, there is a demand that power source circuit be further reduced in size and cost. The power source circuit, however, is composed of a relatively large number of components, and each component needs an anti-heat configuration, thus making it difficult to reduce its size. In particular, the transformer is an essential component in the power source circuit, and wire-coil type transformers have been typically used. However, awire-coil type transformer suffers from various defects such that it is hard to be downsized because of its structure, and the transformer itself is heavy, further still, the conversion efficiency is not very high.

As a means for solving such problems, a piezoelectric transformer has recently drawn attention which transforms input electric energy into mechanical energy by utilizing the piezoelectric effect, and again transforms it into electric energy by utilizing the same effect to thereby boost the voltage. Since the piezoelectric transformer is not a means which performs voltage transformation via magnetic energy using wound wires as in the wire-coil type transformer, it can be designed to be made smaller in size and thickness. If a wire-coil type transformer is attempted to be made thinner, the conversion efficiency would be lowered. Piezoelectric transformers are free from this problem and can achieve a high conversion efficiency.

So far, the means for applying high voltages to the control electrode as the means for controlling the toner flow, has employed high withstand voltage switching elements in order to perform switching of high voltages. The aforementioned disclosure proposed a method which uses piezoelectric transformers, to eliminate the necessity of the high withstand voltage switching elements.

This piezoelectric transformer, however, has a drawback that the output current is low. In a case, for example, where the control electrode is controlled by a single piezoelectric transformer, if the whole of the control electrode is simultaneously turned on, the output current from the voltage source, i.e., the piezoelectric transformer, is markedly increased, so that current exceeding the maximum rated value of the piezoelectric transformer is needed. More specifically, a control electrode to be used for 300 dpi (dot per inch) has 2,560 apertures for A4 sized paper. When one site of the control electrode is turned on, the instantaneous current flowing through the electrode at least needs some 10 $\mu$A. When this is simply multiplied by 2,560, the consumption current instantaneously flowing through them amounts to some 100 mA. A typical piezoelectric transformer has a maximum rated current of 10 to 20 mA, hence only a single transformer cannot meet the requirements.

Recently, one which can supply about 100 mA has been developed for special use. This, however, cannot be used, because the safety standard for information processing devices (including OA apparatus) laid by the UL (Underwriters Laboratories Inc.) specifies that the maximum allowable current of the limiting current circuit should be 70 mA at its peak value. Therefore, a piezoelectric transformer of the aforementioned special type cannot be built in to an image forming apparatus. However, use of a multiple number of normal piezoelectric transformers sharply increases the cost, resulting in a disadvantage.

SUMMARY OF THE INVENTION

The present invention has been devised in view of the above problems, and it is therefore an object of the present invention to provide an image forming apparatus which can supply stable high voltages by voltage boosting without relying on the electromagnetic effect, and can reduce the size of the power source circuit and hence achieve a reduction of the whole apparatus in size and cost.

In order to achieve the above object, the present invention is configured as follows:

In accordance with the first aspect of the invention, an image forming apparatus includes:

a supporting means for supporting developer particles;

an opposing electrode disposed facing the supporting means;

a control electrode disposed between the supporting means and the opposing electrode and having a plurality of gates which form passage for the developer particles; and a power source circuit which supplies required voltages to various components, wherein an electric field is generated at the control electrode to control passage through the gates for the developer particles so as to form an image on a recording medium which is being conveyed between the control electrode and the opposing electrode, and is characterized in that the power source circuit includes:

a reference voltage source for at least producing separate voltage source systems, each producing an independent reference voltage, one being high and the other being low in the variational ratio of consumption energy; and a voltage applying means for applying a voltage which produces a predetermined potential difference between the supporting means and the opposing electrode, based on the reference voltage supplied from the power source system which is low in the variational ratio of consumption energy.

The second aspect of the invention resides in the image forming apparatus having the above first feature, wherein the voltage applying means comprises a piezoelectric transformer to boost the input reference voltage to a predetermined level of potential.

The third aspect of the invention resides in the image forming apparatus having the above second feature, wherein the voltage applying means comprises a voltage dividing means which can produce different high voltages which need to be applied during the image forming operation or other than the image forming operation and have the same polarity with one another.

The fourth aspect of the invention resides in the image forming apparatus having the third feature, wherein the outputs from the voltage dividing means are fed back to the input side so that all the output voltages from the voltage dividing means are corrected as a whole.

The fifth aspect of the invention resides in the image forming apparatus having the second feature, wherein a sinusoidal wave is input to the piezoelectric transformer, and the frequency of the sinusoidal wave is set at a value at which the voltage applying means can output a voltage which is greater than the predetermined maximum voltage.

The sixth aspect of the invention resides in the image forming apparatus having the second feature, wherein the voltage applying means can vary the output voltage in accordance with the variation in the temperature of the piezoelectric transformer itself.

The seventh aspect of the invention resides in the image forming apparatus having the above sixth feature, wherein a heating element is provided in proximity to the piezoelectric transformer.

In accordance with the eighth aspect of the invention, the image forming apparatus having the above seventh feature further comprises a temperature controlling portion for controlling the temperature of the heating element.

In accordance with the ninth aspect of the invention, the image forming apparatus having the above seventh feature further comprises a protecting means for shutting down the voltage supply to the heating element at the event of abnormal heat generation.

The tenth aspect of the invention resides in the image forming apparatus having the second feature, wherein the piezoelectric transformer is arranged at a location distant from heat-generating sources inside the apparatus so that it will not be affected by heat.

The eleventh aspect of the invention resides in the image forming apparatus having the second feature, wherein the piezoelectric transformer is arranged at a location distant from vibration-generating sources inside the apparatus so that it will not be affected by vibrations.

In the configuration in accordance with the above first feature of the invention, the power source system of the reference power source for the voltage applying means is adapted to be separated at least from the power source system having a high variational ratio of consumption energy. Accordingly, the power source system for the voltage applying means will not be affected by the power source system having a high variational ratio of consumption energy, thus it is possible to supply a stable high voltage.

In the second feature of the invention, the voltage applying means has a piezoelectric transformer, which once converts electrical energy into mechanical energy, using the piezoelectric effect and again converts it into electric energy, using the piezoelectric effect to thereby boost the voltage to a predetermined level of potential. Since the voltage applying means applies a voltage to the opposing electrode, which needs little current, a piezoelectric transformer which can supply only a small output current is applicable. Since a piezoelectric transformer is compact as compared to a typical transformer using the electromagnetic effect, the power source circuit can be made compact.

In the third configuration of the invention, the voltage applying means has a voltage dividing means located after the piezoelectric transformer. Accordingly, the voltage applying means can be shared so as to integrate power source circuits for producing different high voltages which need to be applied during the image forming operation or other than the image forming operation as long as they have the same polarity with one another.

In the fourth configuration of the invention, a sinusoidal wave is input to the piezoelectric transformer. This is because a sinusoidal wave is more efficiently transformed as compared to a triangular wave and the like. A piezoelectric transformer has the characteristics that when sinusoidal waves are input, the output from the piezoelectric transformer forms a peak at a certain frequency and lowers on either side thereof. Accordingly, the range of frequency is selected so that the output voltage will exceed the required maximum voltage, thus stably outputting the desired voltages.

In the fifth configuration of the invention, all the voltages output from voltage dividing means provided downstream of the voltage applying means are linearly corrected as a whole. Therefore, it is possible to correct the voltages in a simple circuit configuration to deal with the change of the jumping characteristics of the developer due to change in the environment.

In the sixth configuration of the invention, the output voltage from the piezoelectric transformer is made to vary depending upon the temperature change of the piezoelectric transformer itself. A piezoelectric transformer has the characteristics that the boosting ratio of voltage varies in accordance with temperature, and this is used to change the voltage. In this way, it is possible to control the high voltage with a simple circuit configuration, without the necessity of a complicated circuit (such as a correcting circuit).

In the seventh configuration of the invention, a heating element is provided in proximity to the piezoelectric transformer. Accordingly, the temperature of the piezoelectric transformer can be controlled precisely by the heating element, thus making it possible to stably output the predetermined voltages.

In the eighth configuration of the invention, a temperature controlling portion for controlling the temperature of the heating element is provided in the proximity to the voltage applying means. Accordingly, the temperature of the heating element is controlled with high precision, and hence it is possible to control the voltage from the voltage applying means with high precision.

The ninth configuration of the invention comprises a protecting circuit for shutting down the supply of voltage to the heating element to stop the control if the temperature of the piezoelectric transformer rises sharply due to some unexpected trouble. Accordingly, it is possible to improve the safety and to prevent occurrence of troubles such as breakdown of the circuits.

In the tenth configuration of the invention, the piezoelectric transformer is arranged in a location where, at least, it will not be affected by the heat from the heat-generating sources inside the image forming apparatus. Thus, change to the voltage boosting ratio caused by heat is eliminated, whereby it is possible to prevent the output voltage from the voltage applying means from becoming unstable.

In the eleventh configuration of the invention, the piezoelectric transformer is arranged in a location where, at least, it will not be affected by the vibrations from vibration-generating sources inside the image forming apparatus. Thus, unstableness of the output voltage from the voltage applying means can be suppressed by shutting out vibrations from areas other than the voltage applying means.

DESCRIPTION OF THE PREFERRED EMBODIMENTS

The embodiment of the invention will hereinafter be described with reference to the accompanying drawings.

Figure 1:
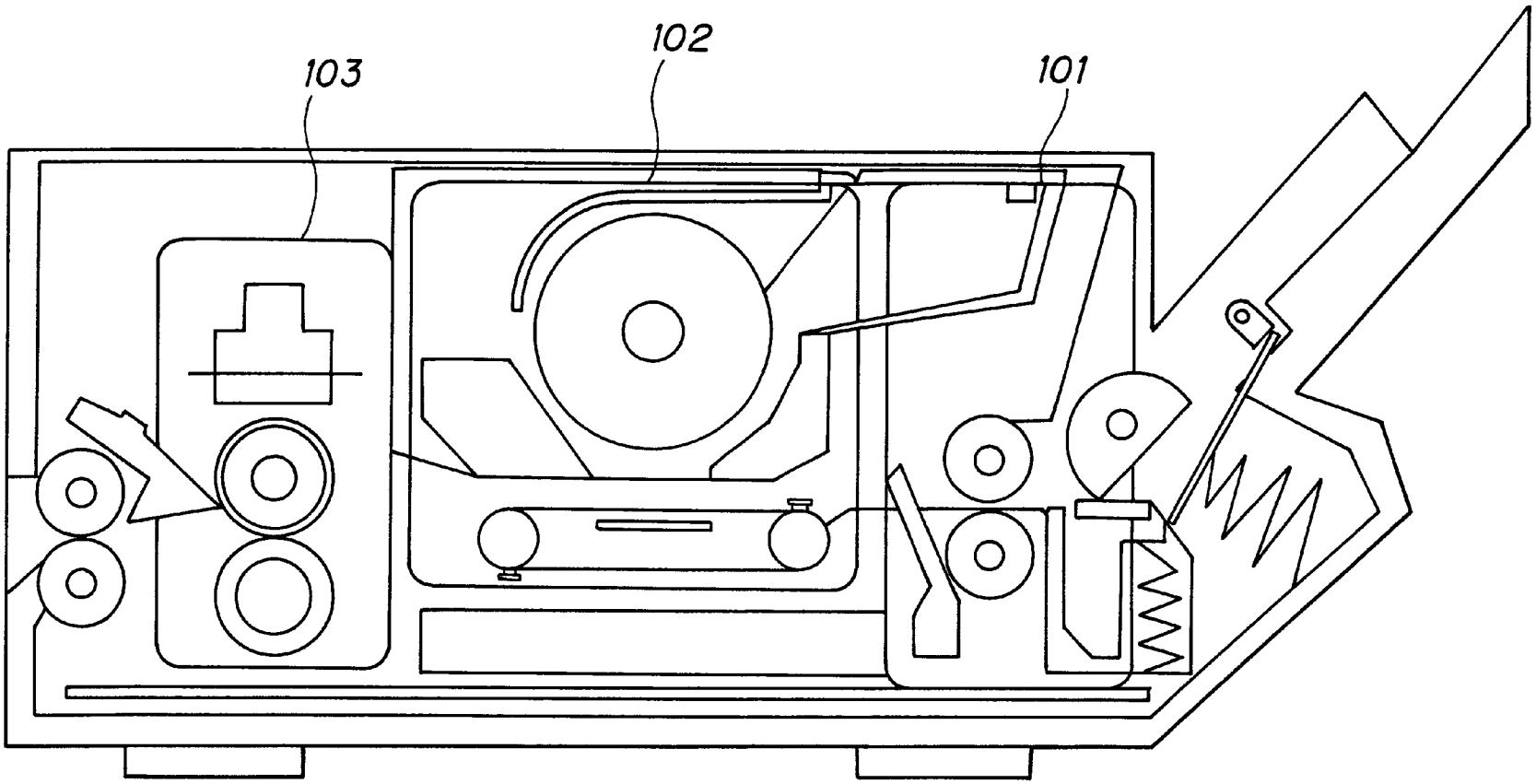
FIG. 1 is a sectional view showing the overall configuration of a printer using an image forming apparatus in accordance with the present invention.
Figure 2:
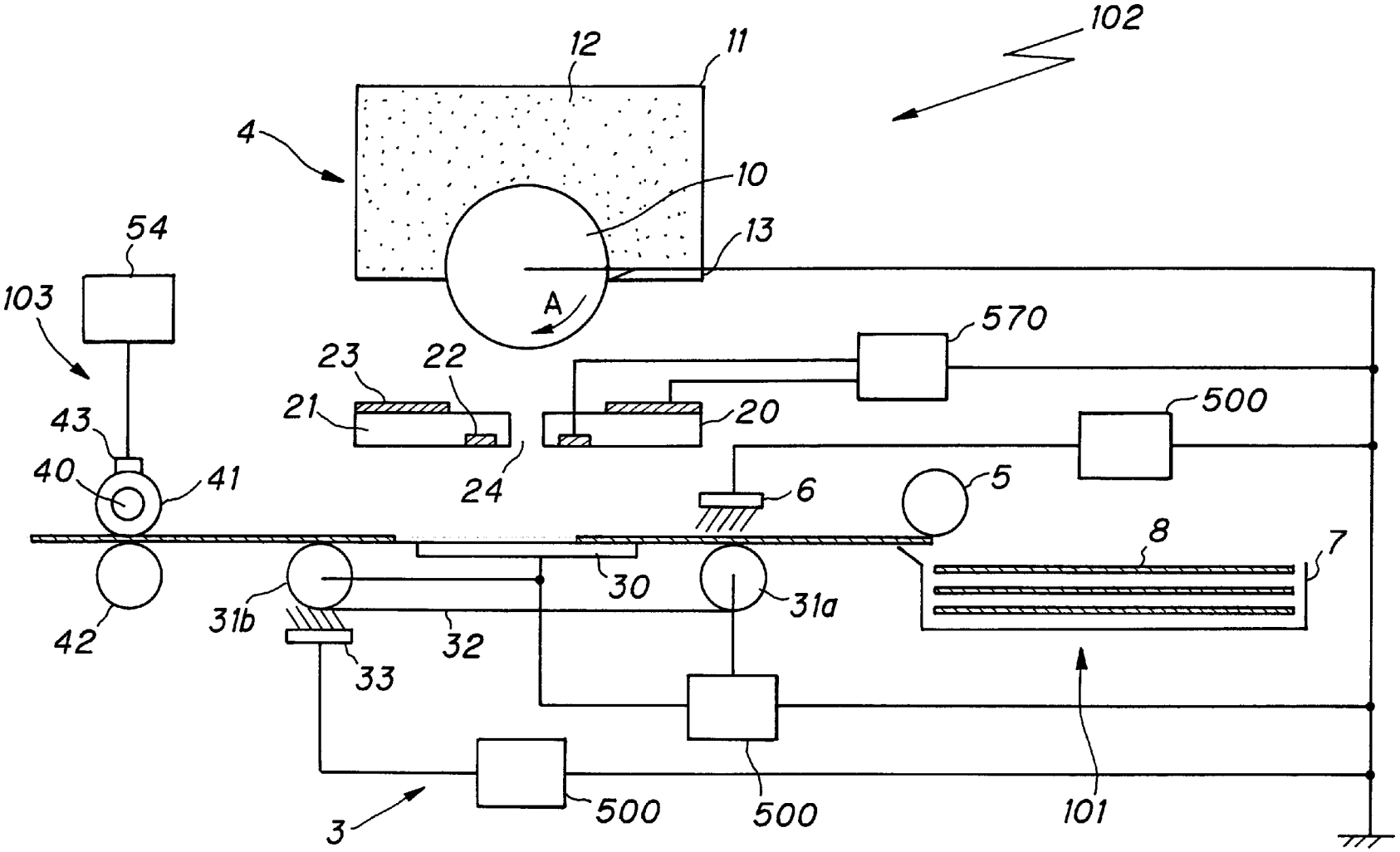
FIG. 2 is a configurational diagram schematically showing essential components of this image forming apparatus.

FIG. 1 is a sectional view showing the overall configuration of a printer using the image forming apparatus in accordance with the present invention. FIG. 2 is a schematic configurational diagram showing essential components of this image forming apparatus. In the following description, the image forming apparatus with a configuration for negatively charged toner will be described, but the polarity of each voltage to be applied may be appropriately set if positive charged toner is used.

(Configuration of the Apparatus)

This image forming apparatus has an image forming unit 102 which is composed of a printing section 3 and a toner supplying section 4. Image forming unit 102 creates a visual image in accordance with an image signal, onto a sheet of paper as recording medium with toner as the developer. In this image forming apparatus, the toner is made to jump and adhere onto the paper whilst the jumping of the toner is controlled based on the image forming signal so as to directly create an image on the paper.

A paper feeder 101 is provided on the input side of image forming unit 102 to which the paper is fed. Paper feeder 101 is composed of a paper cassette 7 for storing paper 8 as recording medium, a pickup roller 5 for delivering paper 8 from paper cassette 7, an unillustrated paper guide for guiding fed paper 8 and a pair of resist rollers. Paper feeder 101 further has unillustrated detecting sensors for detecting the feed of paper 8. Pickup roller 5 is rotationally driven by an unillustrated driving means.

Provided on the output side of image forming unit 102 from which the paper 8 is output, is a fixing unit 103 for heating and pressing the toner image which was formed on paper 8 at the image forming unit 102, to fix it onto paper 8. Fixing unit 103 is composed of a heater 40, a heat roller 41, a pressing roller 42, a temperature sensor 43 and a temperature controlling circuit 54. Heat roller 41 is made up of, for example, an aluminum pipe of 2 mm thick. Heater 40 is a halogen lamp, for example, which is incorporated in heat roller 41. Pressing roller 42 is made of e.g., silicone resin. Heat roller 41 and pressing roller 42 which are arranged opposite to each other, are pressed against one another in order to hold paper 8 in between and press it, with a pressing load, e.g. 2 kg, from unillustrated springs etc., provided at both ends of their shafts. Temperature sensor 43 measures the surface temperature of heat roller 41. Temperature controlling circuit 54 is controlled by a main controller (to be described later) which performs the on/off operation of heater 40 and other control based on the measurement of temperature sensor 43, thus maintaining the surface temperature of heater roller 41 at, for example, 150° C. Fixing unit 103 has an unillustrated paper discharge sensor for detecting the discharge of paper 8. The materials of heater 40, heat roller 41, pressing roller 42, etc., are not specifically limited. The surface temperature of heat roller 41 also is not specifically limited. Further, fixing unit 103 may use a fixing configuration in which paper 8 is heated or pressed to fix the toner image.

Further, although it is not shown in the drawing, the paper output side of fixing unit 103 has a paper discharge roller for discharging paper 8 processed through fixing unit 103 onto a paper output tray and a paper output tray for holding paper 8 thus discharged. The aforementioned heat roller 41, pressing roller 42 and the paper discharge roller are driven by an unillustrated driving means.

Toner supplying section 4 in image forming unit 102 is composed of a toner storage tank 11 for storing toner 12 as the developer, a toner support 10 of a cylindrical sleeve for magnetically supporting toner 12 and a doctor blade 13 which is provided inside toner storage tank 11 to electrify toner 12 and regulate the thickness of the toner layer carried on the peripheral surface of toner support 10. Doctor blade 13 is arranged on the upstream side of toner support 10 with respect to the rotational direction thereof, spaced with a distance of about 60 μm, for example, from the peripheral surface of toner support 10. Toner 12 is of a magnetic type having a mean particle diameter of, for example, 6 μm, and is electrified with static charge of −4 μC/g to −5 μC/g by doctor blade 13. Here, the distance between doctor blade 13 and toner support 10 is not particularly limited. Also the mean particle size, the amount of static charge, etc., of toner 12 are not particularly limited, Toner support 10 is driven by an unillustrated driving means in the direction indicated by arrow A in the figure, with its surface speed set at 80 mm/sec, for example. Toner support 10 is grounded and has unillustrated magnets arranged therein, at the position opposite doctor blade 13 and at the position opposite a control electrode 20 (which will be described later). This arrangement permits toner support 10 to carry toner 12 on its peripheral surface. Toner 12 supported on the peripheral surface of toner support 10 is made to stand up in 'spikes' at the areas on the peripheral surface corresponding the positions of aforementioned magnets. Rotating speed of toner support 10 is not particularly limited. Here, the toner is supported by magnetic force, but toner support 10 can be configured so as to support toner 12 by electric force or combination of electric and magnetic forces.

Printing section 3 in image forming unit 102 includes: an opposing electrode 30 which is made up of an aluminum sheet of, for example, 1 mm thick and faces the peripheral surface of toner support 10; a voltage applying means 500 (to be described later) for generating a high voltage supplied to opposing electrode 30; control electrode 20 provided between opposing electrode 30 and toner support 10; a charge erasing brush 33; a charging brush 6 for charging paper 8; and a dielectric belt 32; support rollers 31*a* and 31*b* for supporting dielectric belt 32. Opposing electrode 30 is arranged e.g., 1.1 mm apart from the peripheral surface of toner support 10. Dielectric belt 32 is made of poly (vinylidene fluoride) (PVDF) as a base material, and is 75 μm thick with a volume resistivity of $10^{10}$ Ω·cm. Dielectric belt 32 is rotated by an unillustrated driving means in the direction of the arrow in the drawing, at a surface speed of 30 mm/sec. Charge erasing brush 33 is pressed against dielectric belt 32 at a position downstream, relative to the rotational direction of dielectric belt 32, and of control electrode 20. The material of opposing electrode 30 is not particularly limited. The distance between opposing electrode 30 and toner support 10 is not particularly specified either. Further, the rotational speed of opposing electrode 30 is not particularly limited.

Control electrode 20 is disposed in parallel to the tangent plane of the surface of opposing electrode 30 and spreads two-dimensionally facing opposing electrode 30, and it has a structure which permits the toner to pass therethrough from toner support 10 to opposing electrode 30. The electric field formed between toner support 10 and opposing electrode 30 varies depending on the potential being applied to control electrode 20 from the control-electrode voltage source, so that the jumping of toner 12 from toner support 10 to opposing electrode 30 is controlled. Control electrode 20 is arranged so that its distance from the peripheral surface of toner support 10 is set at 100 μm, for example, and is secured by means of an unillustrated supporter member.

Figure 3:
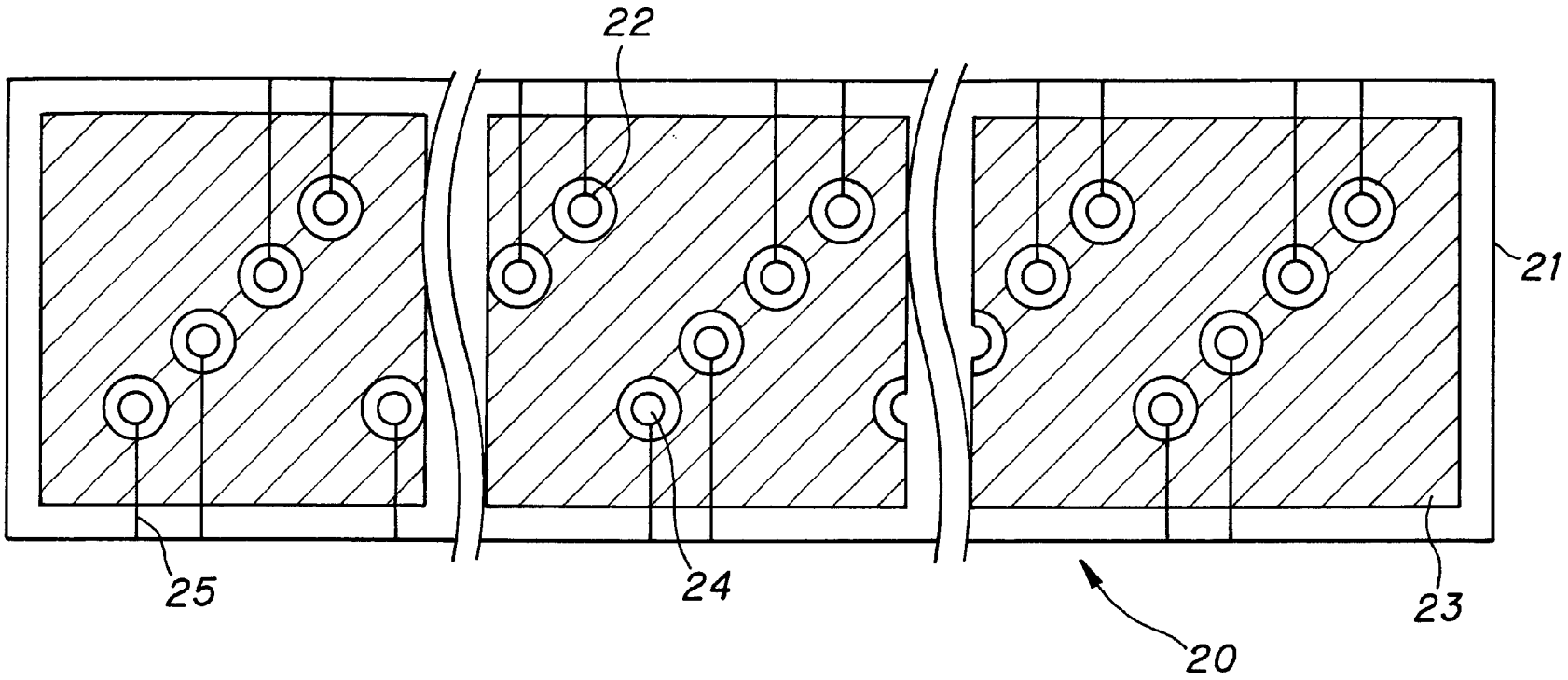
FIG. 3 is a configurational diagram showing a control electrode.

As shown in FIG. 3, control electrode 20 is composed of an insulative board 21, a high voltage driver (not shown), annular conductors independent of one another, i.e., annular electrodes 22 and a sheet-like shield electrode 23 having openings at positions corresponding to annular electrodes 22. Insulative board 21 is made from a polyimide resin, for example, with a thickness of 25 μm. Insulate board 21 further has holes forming gates 24, to be mentioned later, formed therein. Annular electrodes 22 are formed of copper foil and are arranged around the holes, in a predetermined layout. Each opening of the hole is formed with a diameter of 160 μm, for example, forming a passage for toner 12 to jump from toner support 10 to opposing electrode 30. This passage will be termed gate 24 hereinbelow. Shield electrode 23 is made up of copper foil, for example, having openings at positions corresponding to gates 24 and annular electrodes 22 provided therearound. Here, the distance between control electrode 20 and toner support 10 is not particularly limited. Provided over each annular electrode 22 is an opening having an opening diameter of 220 μm. Here, the size of gate 24, the materials and thickness of insulative board 21, annular electrode 22 and shield electrode 23 should not be particularly limited.

Gates 24 or the holes in annular electrodes 22 are formed at, for example, 2,560 sites. Each annular electrode 22 is electrically connected to a control-electrode voltage source 570 via feeder line 25 and a high voltage driver (not shown). Shield electrode 23 is electrically connected via feeder line 25 to control-electrode power source 570. Here, the number of annular electrodes 22 is not particular limited.

The surface of annular electrodes 22, the surface of shield electrode 23, and the surface of feeder lines 25 are covered with an insulative layer of 30 μm thick, which ensures insulation between annular electrodes 22, insulation between feeder lines 25, insulation between annular electrodes 22 and feeder lines 25 which are not connected with each other as well as provides protection of the surface of annular electrodes 22, the surface of shield electrode 23 and the surface of feeder lines 25 from being short-circuited by other components or conductive materials. Here, the material, thickness etc., of the insulative layer are not particularly limited.

Supplied to annular electrodes 22 of control electrode 20 are voltages or pulses in accordance with the image signal from control-electrode voltage source 570. Specifically, control-electrode voltage source 570, supplied a voltage, e.g., 150 V to annular electrodes 22 when toner 12 carried on toner support 10 is made to pass toward opposing electrode 30 while it applies a voltage, e.g., −200 V thereto when the toner is blocked from passing. Shield electrode 23 is applied with −200 V which is applied when toner 12 is prohibited from jumping. This setting is to prevent toner 12 from jumping to control electrode 20.

(Operation of the Apparatus)

Now, the image forming operation of this image forming apparatus will be described. First, the main controller of the printer starts the image forming operation in response to a signal from an unillustrated host computer. Specifically, the image data sent out from the host computer is processed in the image processor, and temporarily stored into the image memory such as RAM (random access memory) etc. As the image data stored in this image memory is transferred to the image forming control unit, it starts to transform the input image data into a control-electrode controlling signal to be imparted to control electrode 20. When the image forming control unit acquires a predetermined amount of the control-electrode controlling signal, an unillustrated driver is activated to rotate pickup roller 5, which delivers a sheet of paper 8 out from paper cassette 7 toward image forming unit 102. At that moment, it is judged whether the paper is fed properly or not by paper feed sensor. Paper 8 delivered out by pickup roller 5 is conveyed between charging brush 6 and support roller 31*a*. Applied from voltage applying means 500 to support members 31*a* and 31*b* is a voltage which is equal to that potential of opposing electrode 30. Supplied to charging brush 6 is a predetermined voltage as the charging potential, to be mentioned below. Paper 8 is provided with charge by the potential difference between charging brush 6 and support members 31*a* and 31*b*. Thus, paper 8, whilst it is being electrostatically attracted to dielectric belt 32, is conveyed to a position in printing section 3 of image forming unit 102, where dielectric belt 32 faces toner support 10.

Then, control-electrode voltage source 570 supplies voltages to control electrode 20 in accordance with the image data. This supplying of voltage is performed in synchronization with the supply of paper 8 to the printing section by charging brush 6. Control-electrode voltage source 570, in accordance with the image data signal, applies a voltage of 150 V or −200 V to designated sites of control electrode 20 in an appropriate manner, so as to control the electric field near control electrode 20. Illustratively, at each gate 24 of control electrode 20, the jumping of toner 12 from toner support 10 toward opposing electrode 30 is prevented or permitted appropriately in accordance with the image data. Thus, a toner image in conformity with the image signal is formed on paper 8 which is moving at the rate of 30 mm/sec toward the paper output side by the rotation of support members 31*a* and 31*b*. Paper 8 with the toner image formed thereon is separated from dielectric belt 32 by the curvature of support roller 31*b* and is conveyed to fixing unit 103, where the toner image is fixed to paper 8. Paper 8 with the toner image fixed thereon is discharged by the discharge roller onto paper output tray. At the same time, the fact that the paper is properly discharged is detected by the paper discharge sensor. Based on this detection, the main controller of the printer determines that the printing operation has been completed normally.

By the image forming operation described above, a good image is created on paper 8. Since this image forming apparatus directly forms the image on paper 8, it is no longer necessary to use a developer medium such as photoreceptor, dielectric drum, etc., which were used in conventional image forming apparatuses. As a result, the transfer operation for transferring the image from the developer medium to paper 8 can be omitted, thus eliminating the degradation of the image and improving the reliability of the apparatus. Since the configuration of the apparatus can be simplified needing fewer parts, it is possible to reduce the apparatus in size and cost.

Although the image forming apparatus in accordance with the invention is applied to the printing section of a printer, it is possible, needless to say, to apply it to the printing section of facsimile machines and digital copiers.

(Power Source Circuit)

Next, the power source circuit in accordance with one embodiment of the invention will be described.

Figure 4:
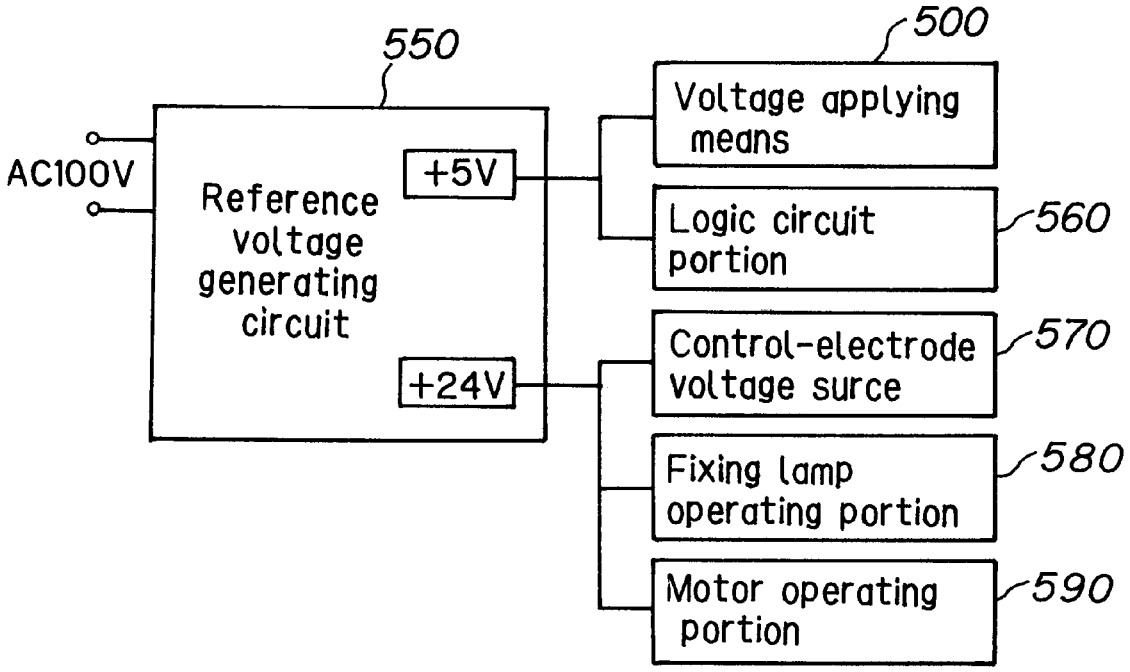
FIG. 4 is a block diagram showing a power source circuit.

First, the supply path of the reference voltages in the power source circuit of this image forming apparatus will be described with reference to FIG. 4. The voltage from the commercial power supply, i.e., AC 100 V is input to a reference voltage generating circuit 550, which generates +5 V and +24 V as the reference voltages, and supplies these voltages to various operating units. The reference voltage of the +5 V system is supplied to a logic circuit 560 which is mainly composed of the aforementioned main controller etc. as well as to an aftermentioned voltage applying means 500. The reference voltage of the +24 V system is supplied to a control electrode voltage source 570 for generating the voltage to be applied to control electrode 20, a fixing lamp operating portion 580 for generating the voltage to activate heater 40 as a part of fixing unit 103, and a motor driving portion 590 for operating motors for driving various driving devices.

Here, since the latter reference voltage from the +24 V system, serves as the reference voltage for operating the driving devices relating the image forming operation, the ratio of the variations in consumption energy during image forming is greater than that of the former reference voltage from the +5 V system. For example, heater 40 of fixing unit 103 which is operated by the reference voltage from the +24 V system, is repeatedly and frequently turned on and off so as to maintain the surface temperature of the aforementioned heat roller 41 at 150° C. Therefore, the level of the reference voltage varies between the time when the halogen lamp is on and when it is off, and hence this reference voltage becomes unstable while the halogen lamp is being controlled. Since the halogen lamp needs a long time before its characteristics being stabilized when it is first activated, in order to achieve an improved printing speed, the halogen lamp is intermittently turned on and off from when the main power of the image forming apparatus is activated until the main power is deactivated. This degrades the continual stability of the reference voltage of the +24 V system. Additionally, +24 V is supplied to the motor driving unit, so that the reference voltage of the +24 V system will also become unstable when the motors are turned on and off.

With such an unstable reference voltage being supplied to voltage applying means 500, the conversion efficiency of the transformer (detailed later) constituting voltage applying means 500 lowers, causing the problem that the predetermined high voltages cannot be obtained. For this reason, the power source of the reference voltage to enable voltage applying means 500 to generate high voltages must be separated from the +24 V system, which has a large variation in consumption energy, so that it can provide a stable voltage. In this embodiment, only two systems of reference voltage is used, and the reference voltage for voltage applying means 500 is supplied from the +5V system which has a relatively high stability.

Figure 5:
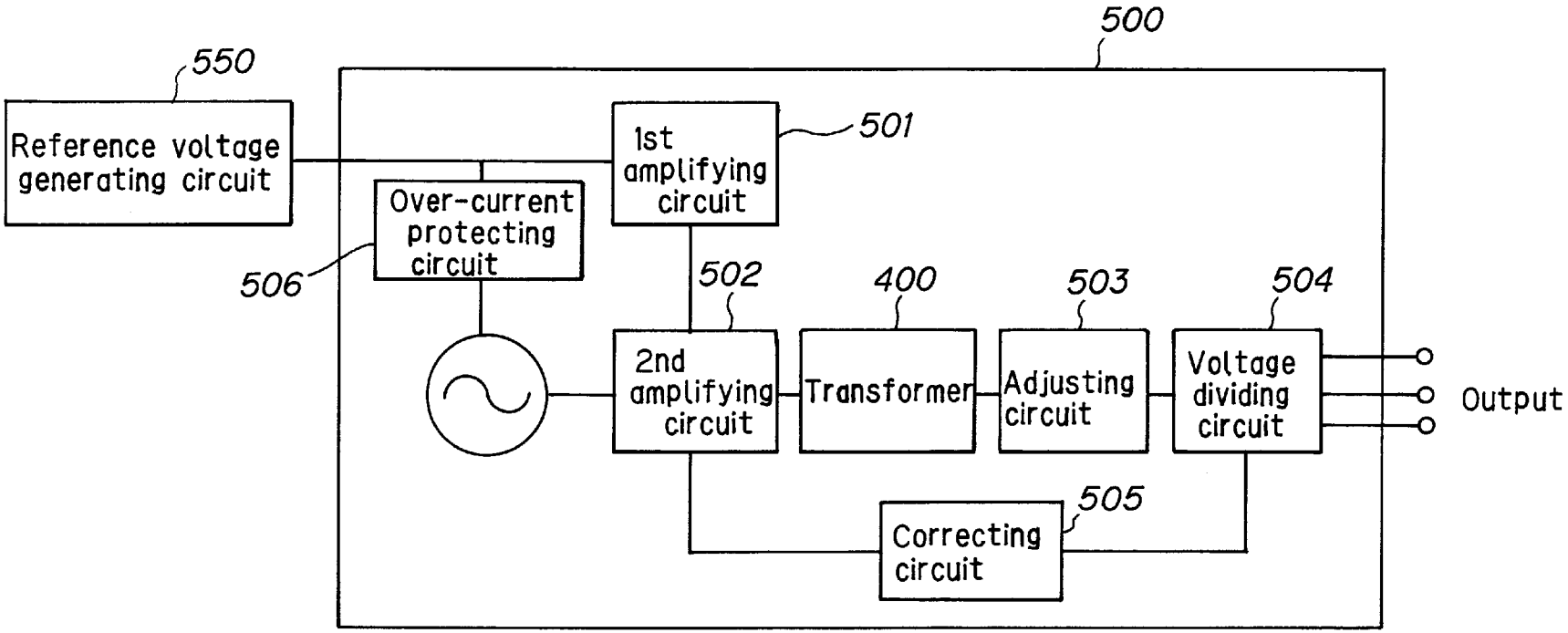
FIG. 5 is a block diagram showing a voltage applying means.

Next, the configuration of voltage applying means 500 will be described with reference to FIG. 5. In FIG. 5, voltage applying means 500 includes: a first amplifying circuit 501 amplifying the reference voltage of +5V for supplying it to a transformer; a second amplifying circuit 502 which amplifies the sinusoidal wave generated from an oscillator (shown by the symbol) up to the level of the voltage which was amplified by first amplifying circuit 501; a transformer 400 boosting the voltage which was amplified to the predetermined level through the second amplifying circuit, to a high voltage; an adjusting circuit 503 for adjusting the high voltage thus boosted, in accordance with its usage; a voltage dividing circuit 504 which divides the adjusted voltage and supplies the divided voltages to a plurality of subsequent elements; a correcting circuit 505 which, as a whole, corrects the high voltage to be voltage divided at voltage dividing circuit 504; and an over-current protecting circuit 506 for preventing the breakdown of circuits due to an inflow of over-current at the event of an unexpected trouble.

Figure 6:
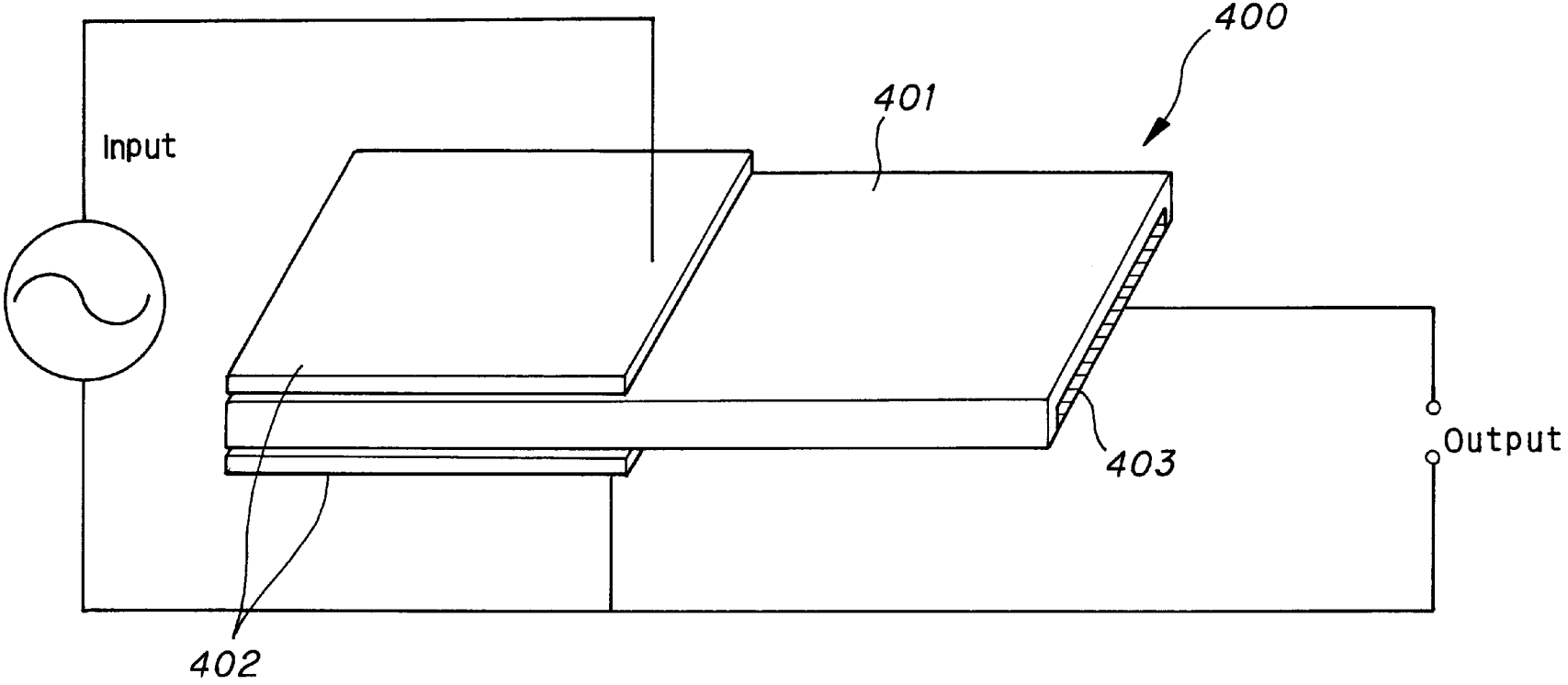
FIG. 6 is an illustrative view showing a piezoelectric transformer.

First, description will be made of transformer 400 which is equipped for producing a high voltage. As described heretofore, typical transformers are those of a wire-coil type which make use of the electromagnetic effect to boost the voltage. Such a transformer suffered from various defects such that it is hard to be downsized because of its structure, and the transformer itself is heavy, further still, the conversion efficiency is not very high. To compensate for these defects, an additional circuit was provided heretofore, but in view of reducing the price it is not preferred. This is why the present invention employs a piezoelectric transformer 400 which can simplify the circuit configuration and is free from the aforementioned problems. FIG. 6 shows a basic structure of piezoelectric transformer 400. Shown in FIG. 6 is a Rosen type piezoelectric transformer, which is constructed of a base 401 which is formed by sintering, for example, powdered ceramic materials so as to have an enhanced mechanical strength, first electrodes 402 and a second electrode 403. First electrodes 402 and second electrode 403 are formed by, for example, thermo-pressed silver foils, etc. First electrodes 402 are of a pair of electrodes which are arranged on opposite sides with base 401 in between. Here, the materials of first electrode 402, second electrode 403 are not particularly limited.

A sinusoidal wave is generated from the oscillator (shown by the symbol) on the input side and this is applied between first electrodes 402. During this application, the transformer produces a strong mechanical vibration in its longitudinal direction so as to generate charge from the piezoelectric effect and hence output a high voltage between second electrode 403 and one of first electrodes 402.

Figure 7:
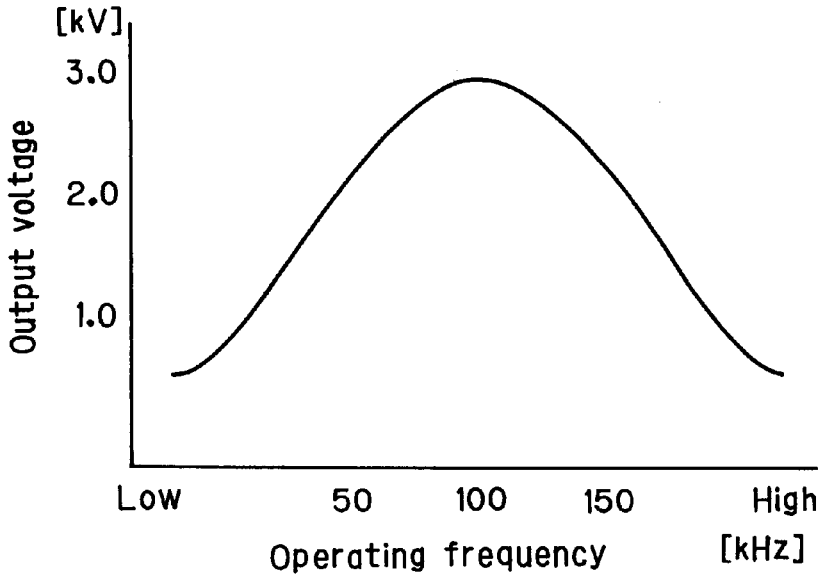
FIG. 7 is a chart showing the relationship between the output voltage from the piezoelectric transformer and the operating frequency.

The oscillator provided on the input side of piezoelectric transformer 400 outputs a sinusoidal wave for operating this piezoelectric transformer 400, and the operating frequency should be 50 kHz at its minimum and 150 kHz at its maximum. This is specified because piezoelectric transformer 400 varies in its boosting transformation ratio depending upon the operating frequency. For example, as shown in FIG. 7, the output voltage and the operating frequency have such a relationship that the output voltage peaks around 100 kHz and lowers on either side thereof, i.e., when the operating frequency decreases or when it increases. Accordingly, the operating frequency required for supplying all the voltages output from this power source circuit, specifically, the voltage to be applied to the opposing electrode, the voltage to be applied to the charge erasing brush and the voltage to be applied to the charging brush, ranges from 50 kHz (at minimum) to 150 kHz (at maximum).

For example, concerning the voltages of this embodiment, a voltage of 2.3 kV is applied to opposing electrode 30, 2.5 kV to charge erasing brush 33, and 1.2 kV to the charging brush. In this case, the operating frequency is set at 80 kHz for the highest voltage of all to be output, in this case the voltage to the charge erasing brush. The other voltages can be obtained by voltage dividing the highest voltage. Since piezoelectric transformer 400 boosts the voltage by mechanical vibrations, the transformer must be disposed as remote from vibration-generating sources in the apparatus as possible so that the mechanical vibration of the piezoelectric transformer will not be adversely affected. In this way, it is possible to obtain a stable high voltage.

First amplifying circuit 501 amplifies the reference voltage of +5V to +30V. This is because when the load capacity on the output side of piezoelectric transformer 400 and the voltage boosting ratio are set constant, the higher the input voltage the higher the output voltage. For example, when the boosting ratio is set at 100, an input voltage of +5V is raised to 500 V. If the input is set at +30V, the output voltage can be boosted to 3,000 V.

Second amplifying circuit 502 is to amplify the sinusoidal wave generated from the oscillator up to the level of the voltage which has been amplified by first amplifying circuit 501. The reason a sinusoidal wave is used is that piezoelectric transformer 400 generates a sinusoidal vibration from the piezoelectric effect, so that it outputs a sinusoidal wave. Therefore, when the input voltage is given in the form of a sinusoidal one, the vibration can more easily propagate than one having a rectangular or triangular waveform. In this way, the reference voltage is adjusted by the adjusting means such as first amplifying circuit 501 and second amplifying circuit 502, thus making it possible to provide a more stabilized high voltage.

Output adjusting circuit 503 rectifies the sinusoidal high voltage output from piezoelectric transformer 400, producing a d.c. high voltage. This is because all the voltages to be supplied to the components in this image forming apparatus are of d.c. voltage. If an a.c. voltage needs to be used, only rectification is performed by omitting the transforming portion. This rectifying operation and d.c. conversion, or only the rectifying operation, performed by output adjusting circuit 503, makes it possible to produce stable high voltages.

Voltage dividing circuit 504 is adapted to produce predetermined voltages by voltage division, using resistances etc. for example, so that the high-voltage output from piezoelectric transformer 400 can be supplied to different components. In this case, the voltages having the same polarity among the high voltages required for this image forming apparatus, can be produced from a common circuit by dividing the voltage therefrom through this voltage dividing circuit 504. Illustratively, voltage applying means 500 is connected to opposing electrode 30 in order to generate the predetermined potential difference between toner support 10 and opposing electrode 30. Additionally, this applies a specified high voltage to charge erasing brush 33 which is provided to erase unnecessary charge existing on the surface of dielectric belt 32 as well as applies a specified high voltage to charging brush 6 which is equipped to electrify paper 8. In this case, three high-voltage source circuits are usually and conventionally needed, but the circuit configuration of the present invention can replace the conventional configuration, enabling a single high-voltage power source circuit to supply all the high voltages to these components. In the mode of this embodiment, a voltage of 2.3 kV is applied to opposing electrode 30, 2.5 kV is applied to charge erasing brush 33, and 1.2 kV is applied to the charging brush.

Correcting circuit 505 has a feedback circuit configuration so that the values of all the voltages obtained by voltage division can be corrected as a whole. For example, it may happen that the jumping characteristics of toner 12 vary with change in the environment, and hence the amount of jumping toner 12 decreases, to thereby degrade the quality of printing. In other cases, it may happen that the charge characteristics of paper 8 vary with change in the environment and hence the charging voltage for the environment of normal temperature and humidity cannot cause paper 8 to be attracted to dielectric belt 32 due to shortage in static charge so that conveyance is degraded, resulting in occurrence of troubles such as paper jam and the like. In order to solve such problems, this correcting circuit will correct the values of the voltages in accordance with change in the environment, to thereby suppress the occurrence of these problems. Further, since these corrections can be performed as a whole, the control can be easily and quickly performed.

Over-current protecting circuit 506 stops the oscillation of the oscillator which is provided on the input side of piezoelectric transformer 400, so as to suspend the output of the high voltages to thereby prevent the breakdown of circuits due to an inflow of over-current at the event of an unexpected troubles.

The maximum current supply capability of voltage applying means 500 must be limited to 70 mA or less. This is because the safety standard for information processing devices (including OA apparatus) laid by the UL (Underwriters Laboratories Inc.) specifies that the maximum allowable current of the limiting current circuit should be 70 mA at its peak value.

Figure 8:
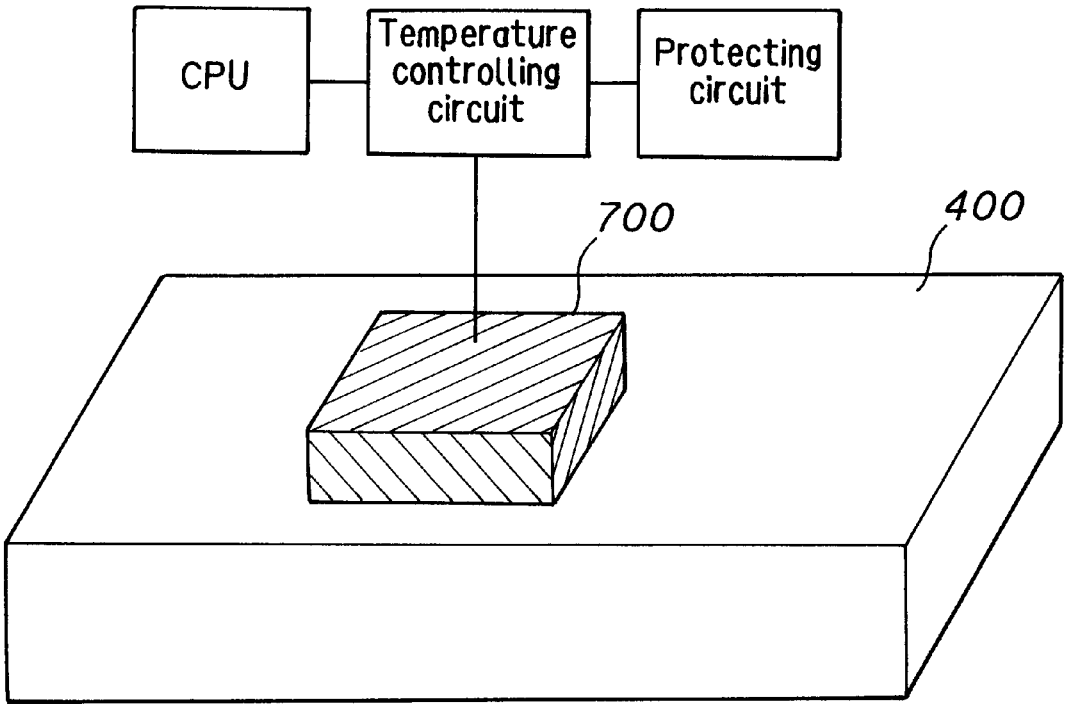
FIG. 8 is an illustrative view showing a circuit configuration when a heating element is provided in proximity to the piezoelectric transformer.

Further, another advantage of use of piezoelectric transformer 400 can be obtained based on such a physical property of piezoelectric transformer 400 that its voltage boosting ratio will vary with change in temperature thereof. By controlling the temperature of piezoelectric transformer 400 taking advantage of this property, it is possible to adjust the output voltage without the necessity of any circuit for adjusting the voltage. For this purpose, piezoelectric transformer 400 is packaged and a heating element 700 is provided in proximity thereto, as shown in FIG. 8. This heating element 700 may be controlled by the main controller, i.e., CPU, so that the temperature controlling circuit performs the ON/OFF control of heating element 700, to make it possible to maintain piezoelectric transformer 400 at the desired temperature.

Figure 9:
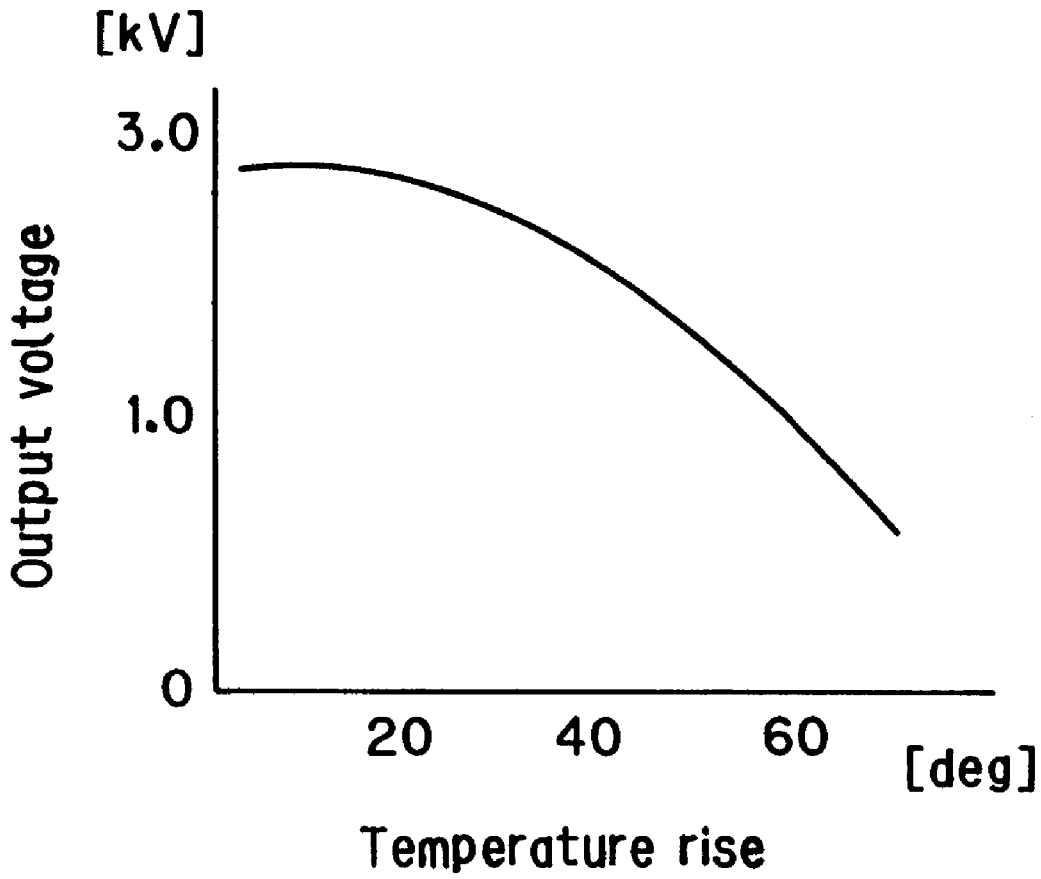
FIG. 9 is a graph showing the variations of the output voltage from the piezoelectric transformer depending upon the temperature rise of the piezoelectric transformer itself.

The relationship between the output voltage from piezoelectric transformer 400 and the temperature variation is such that, as shown in FIG. 9, when the output voltage is about 3.0 kV at normal temperature, i.e., 25° C., the output voltage becomes reduced to about 1.0 kV when the temperature rise is 60 degrees. In this case, the temperature rise is limited to 60 degrees or less. This is reasoned as follows: For example, when the output voltage varies under an surrounding temperature of 35° C. which is considered a high temperature environment, the temperature of the piezoelectric transformer is controlled to below 100° C., specifically at 95° C., even if the temperature rise is set at maximum, i.e., 60 degrees. A temperature in excess of 100° C. or more will not allow the output from piezoelectric transformer 400 to be raised to a desired level of voltage and might affect the components adjacent thereto. For this reason, a protecting circuit which shuts down the supply of voltage to heating element 700 and stops the control, is provided whereby it is possible to improve the safety as well as prevent the occurrence of troubles such as breakdown of circuits when piezoelectric transformer 400 sharply rises in temperature by some unexpected trouble.

Further, in order to allow only the heat from heating element 700 to exclusively affect the temperature of the transformer, it is better to arrange the piezoelectric transformer at a location as distant from other heat-generating sources as possible. For example, the transformer should not be placed near fixing unit 103 etc. This makes it possible to perform temperature control with high precision.

Thus, the introduction of the configuration of the present invention makes the power source circuit compact. Further, in order to reduce the apparatus in size, use of the piezoelectric transformer in the voltage applying means which needs only a relative low current but a high voltage maximizes the advantage of piezoelectric transformers without revealing the disadvantages of piezoelectric transformer, thereby making it possible to supply a stabilized high voltage as well as reducing the size of the power source circuit and therefore achieving reduction of the whole apparatus in size and cost.

In accordance with the above first configuration, by configuring the reference power source for the voltage applying means which is separated at least from the power source system having a high variational ratio of consumption energy, it is possible to supply a stable high voltage and it is possible to make the power source circuit compact, thus achieving reduction of the whole apparatus in size and cost.

In accordance with the second configuration, since the voltage applying means uses a piezoelectric transformer, it is possible to make the power source circuit compact. Since this voltage applying means supplies its output voltage to the portions which need high voltages but can operate with a relatively low current, it is possible to effectively use the advantages of the piezoelectric transformer. Accordingly, it is possible to supply a stable high voltage and it is possible to make the power source circuit compact, thus achieving reduction of the whole apparatus in size and cost.

In accordance with the third configuration, the voltage applying means can be shared so as to produce different high voltages which need to be applied during the image forming operation or other than the image forming operation as long as they have the same polarity with one another. Accordingly, the power source circuits for generating high voltages can be integrated, thus achieving reduction of the apparatus in size and cost.

In accordance with the fourth configuration, a sinusoidal wave is input to the piezoelectric transformer so as to improve the converting efficiency. Further, concerning the piezoelectric transformer, the range of frequency of the sinusoidal wave is selected in such a manner that the output voltage will exceed the required maximum voltage, thus enabling the voltage applying means to stably supply desired high voltages to the voltage applying means.

In accordance with the fifth configuration, since all the voltages output from voltage dividing means provided downstream of the piezoelectric transformer are linearly corrected as a whole, it is possible to correct the voltages with a simple circuit configuration to deal with the change of the jumping characteristics of the developer due to change in the environment, thus making it possible to produce images of high print quality.

In accordance with the sixth configuration, the voltage from the piezoelectric transformer is made to vary depending upon the temperature change of the piezoelectric transformer itself. As a result, it is possible to control the high voltage with a simple circuit configuration, without the necessity of a complicated circuit.

In accordance with the seventh configuration, since a heating element is provided in proximity to the piezoelectric transformer, the temperature control of the transformer can be performed more precisely, thus making it possible to stably output the predetermined voltages.

In accordance with the eighth configuration, a temperature controlling portion for controlling the temperature of the heating element is provided in the proximity to the piezoelectric transformer. Accordingly, the temperature of the heating element is controlled with high precision, and hence it is possible to control the voltage from the voltage applying means with high precision.

In accordance with the ninth configuration, since a protecting circuit for shutting down the supply of voltage to the heating element and stopping the control is provided, it is possible to improve the safety and to prevent occurrence of troubles such as breakdown of the circuits when piezoelectric transformer sharply rises in temperature by some unexpected troubles.

In accordance with the tenth configuration, the piezoelectric transformer is arranged in a location where, at least, it will not be affected by the heat from the heat-generating sources inside the image forming apparatus. Thus, unstableness of the output voltage from the piezoelectric transformer due to heat can be prevented so that the transformer can constantly output a stable high voltage.

In accordance with the eleventh configuration, the piezoelectric transformer is arranged in a location where, at least, it will not be affected by the vibrations from vibration-generating sources inside the image forming apparatus. In this way, by preventing the piezoelectric transformer from being adversely affected by vibrations, unstableness of the output voltage from the piezoelectric transformer can be suppressed so that the transformer can output a predetermined high voltage which is constantly stable.

What is claimed is:

1. An image forming apparatus comprising:

supporting means for supporting electrostatically charged developer particles;

an opposing electrode disposed facing said supporting means;

a control electrode disposed between said supporting means and said opposing electrode, said control electrode defining a plurality of gates which form passages for said developer particles; and, a power source circuit adapted to supply required voltages to various components of said image forming apparatus, wherein an electric field is generated at said control electrode to control the passage through said gates of said developer particles so as to form an image on a recording medium which is conveyed between said control electrode and said opposing electrode, characterized in that said power source circuit comprises:

a reference voltage source for producing at least two separate reference voltage source systems, each said reference voltage source system being adapted to produce an independent reference voltage, at least one of said reference voltage source systems being adapted to be connected to certain of said various components of said image forming apparatus which have high variations in energy consumption over time, and at least another of said reference voltage source systems being adapted to be connected to certain of said various components of said image forming apparatus which have low variations in energy consumption over time; and, voltage applying means for applying a voltage which produces a predetermined potential difference between said supporting means and said opposing electrode, based upon a reference voltage supplied from said power source circuit which is adapted for connection to various components of said image forming apparatus having low variations in energy consumption over time.

2. The image forming apparatus according to claim 1, wherein said voltage applying means comprises a piezoelectric transformer having an input and an output, said piezoelectric transformer being adapted to selectively boost an input reference voltage to a predetermined maximum level of potential.

3. The image forming apparatus according to claim 2, wherein said voltage applying means comprises a voltage dividing means having an input and at least two outputs, said voltage dividing means being adapted to provide different high voltages which need to be applied during the image forming operation or other than the image forming operation, each of said high voltages being of the same polarity.

4. The image forming apparatus according to claim 3, wherein said outputs from said voltage dividing means are fed back to said input of said voltage dividing means so that all of said output voltages from said voltage dividing means are corrected as a whole.

5. The image forming apparatus according to claim 2, wherein a sinusoidal wave is input to said piezoelectric transformer, and the frequency of said sinusoidal wave is set at a value at which said voltage applying means can output a voltage which is greater than a predetermined maximum voltage.

6. The image forming apparatus according to claim 2, wherein said voltage applying means can vary the output voltage of said piezoelectric transformer in accordance with variations in the temperature thereof.

7. The image forming apparatus according to claim 6, wherein a heating element is provided in proximity to the piezoelectric transformer.

8. The image forming apparatus according to claim 7, further comprising a temperature-controlling portion for controlling said heating element.

9. The image forming apparatus according to claim 7, further comprising a protecting means for monitoring said heating element and for shutting down said heating element if abnormal heat is generated therein.

10. The image forming apparatus according to claim 2, wherein said piezoelectric transformer is arranged at a location distant from all heat-generating sources in said apparatus so that said piezoelectric transformer will not be affected by externally generated heat.

11. The image forming apparatus according to claim 2, wherein said piezoelectric transformer is arranged at a location distant from all vibration-generating sources in said apparatus so that said piezoelectric transformer will not be affected by externally generated vibrations.

* * * * *